US007357189B2

(12) United States Patent
Aldaz et al.

(10) Patent No.: US 7,357,189 B2
(45) **Date of Patent: *Apr. 15, 2008**

(54) SEAL

(75) Inventors: Walter Aldaz, Kuala Lumpur (MY); Andrew Michael Duggan, Aberdeen (GB); James Kennon Whanger, Houston, TX (US); Neil Andrew Abercrombie Simpson, Aberdeen (GB); Simon John Harrall, Houston, TX (US); James Oliver, Sugar Land, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 146 days.

This patent is subject to a terminal disclaimer.

(21) Appl. No.: 10/778,003

(22) Filed: Feb. 12, 2004

(65) Prior Publication Data

US 2005/0016740 A1 Jan. 27, 2005

Related U.S. Application Data

(63) Continuation-in-part of application No. 10/443,442, filed on May 22, 2003, now Pat. No. 6,988,557.

(51) Int. Cl.
*E21B 23/02* (2006.01)

(52) U.S. Cl. ..... 166/380; 166/187; 166/207

(58) Field of Classification Search ..... 166/380, 166/186, 207, 326, 187

See application file for complete search history.

(56) References Cited

U.S. PATENT DOCUMENTS 1,854,518 A * 4/1932 Little ..... 137/516.15

(Continued)

FOREIGN PATENT DOCUMENTS

EP 0 237 662 9/1987

(Continued)

OTHER PUBLICATIONS

U.K. Search Report, Application No. GB 0303152.3, dated Jun. 11, 2003.

(Continued)

*Primary Examiner*—William P Neuder
(74) *Attorney, Agent, or Firm*—Patterson & Sheridan, L.L.P.

(57) ABSTRACT

There is disclosed an expandable seal for sealing at least part of a wall of a well borehole, an expandable seal assembly comprising at least two such expandable seals, and a method of sealing at least part of a well borehole using such a seal. In one embodiment, the expandable seal (32) comprises an expandable tubular support member (34) and an inflatable seal element (36) mounted externally of the expandable tubular support member (34) for inflation radially outwardly into sealing engagement with at least part of a wall (50) of a well borehole (10). There is also disclosed a sealing apparatus for sealing at least one flow port in an expandable downhole tubular, in one embodiment, the sealing apparatus (332) comprising a sealing member (384) coupled to an expandable tubular (334), the sealing member (384) including a deformable portion (387) movable between a closed position preventing fluid flow through a flow port (356) and an open position permitting fluid flow through the flow port (356).

79 Claims, 11 Drawing Sheets

U.S. PATENT DOCUMENTS

| | | | | |
|---|---|---|---|---|
| 2,306,160 | A | 12/1942 | Freyssinet | 288/6 |
| 2,519,116 | A | 8/1950 | Crake | 166/10 |
| 2,656,891 | A | 10/1953 | Toelke | 166/13 |
| 2,814,517 | A | 11/1957 | Razdow | 288/20 |
| 2,945,541 | A | 7/1960 | Maly et al. | 166/187 |
| 3,083,775 | A | 4/1963 | Nielson et al. | |
| 3,147,016 | A | 9/1964 | Traufler | 277/226 |
| 3,385,367 | A | 5/1968 | Kollsman | 166/191 |
| 3,593,799 | A | 7/1971 | Boughton et al. | 166/295 |
| 3,677,987 | A | 7/1972 | Pence, Jr. | 260/29.6 |
| 3,690,375 | A | 9/1972 | Shillander | 166/187 |
| 3,740,360 | A | 6/1973 | Nimerick | 260/17.4 |
| 3,918,523 | A | 11/1975 | Stuber | 166/285 |
| 4,078,606 | A | 3/1978 | Montgomery | 166/120 |
| 4,137,970 | A | 2/1979 | Laflin et al. | 166/292 |
| 4,244,590 | A | 1/1981 | Sanford | |
| 4,253,676 | A | 3/1981 | Baker et al. | |
| 4,300,775 | A | 11/1981 | Ringel | 277/34.3 |
| 4,310,161 | A | 1/1982 | Streich | |
| 4,403,660 | A | 9/1983 | Coone | 166/387 |
| 4,406,469 | A | 9/1983 | Allison | 277/123 |
| 4,452,463 | A | 6/1984 | Buckner | 277/120 |
| 4,457,369 | A | 7/1984 | Henderson | 166/125 |
| 4,545,433 | A | 10/1985 | Wambaugh | |
| 4,601,498 | A | 7/1986 | Haugen | 285/332.3 |
| 4,633,950 | A | 1/1987 | Delhommer et al. | 166/295 |
| 4,662,450 | A | 5/1987 | Haugen | 166/299 |
| 4,674,570 | A | 6/1987 | Jackson | 166/187 |
| 4,730,670 | A | 3/1988 | Kim | 166/134 |
| 4,762,179 | A | 8/1988 | Wesson et al. | 166/297 |
| 4,836,940 | A | 6/1989 | Alexander | 252/8.512 |
| 4,862,967 | A | 9/1989 | Harris | 166/387 |
| 4,886,117 | A | 12/1989 | Patel | 166/187 |
| 4,907,651 | A | 3/1990 | Bou-Mikael | 166/114 |
| 4,913,232 | A | 4/1990 | Cheymol et al. | 166/285 |
| 4,919,989 | A | 4/1990 | Colangelo | |
| 4,936,386 | A | 6/1990 | Colangelo | |
| 5,086,841 | A | 2/1992 | Reid et al. | 166/295 |
| 5,165,703 | A | 11/1992 | Morvant | 277/188 |
| 5,226,492 | A | 7/1993 | Solaeche P. et al. | 166/196 |
| 5,271,469 | A | 12/1993 | Brooks et al. | 166/387 |
| 5,309,993 | A | 5/1994 | Coon et al. | 166/115 |
| 5,311,938 | A | 5/1994 | Hendrickson et al. | 166/134 |
| 5,361,836 | A | 11/1994 | Sorem et al. | |
| 5,511,620 | A | 4/1996 | Baugh et al. | 166/387 |
| 5,605,195 | A | 2/1997 | Eslinger et al. | 166/387 |
| 5,623,993 | A | 4/1997 | Van Buskirk et al. | 166/292 |
| 5,676,384 | A | 10/1997 | Culpepper | 277/188 |
| 5,749,585 | A | 5/1998 | Lembcke | 277/116.2 |
| 5,787,987 | A | 8/1998 | Forsyth et al. | 166/313 |
| 5,803,178 | A | 9/1998 | Cain | 166/306 |
| 5,833,001 | A | 11/1998 | Song et al. | 166/287 |
| 5,875,847 | A | 3/1999 | Forsyth | 166/313 |
| 5,941,313 | A | 8/1999 | Arizmendi | 166/387 |
| 6,009,951 | A | 1/2000 | Coronado et al. | 166/387 |
| 6,041,858 | A | 3/2000 | Arizmendi | 166/187 |
| 6,059,038 | A * | 5/2000 | Vick, Jr. | 166/319 |
| 6,073,692 | A * | 6/2000 | Wood et al. | 166/187 |
| 6,425,444 | B1 | 7/2002 | Metcalfe et al. | |
| 6,446,717 | B1 | 9/2002 | White et al. | 166/187 |
| 6,457,518 | B1 | 10/2002 | Castano-Mears et al. | |
| 6,702,030 | B2 | 3/2004 | Simpson | |
| 6,854,522 | B2 * | 2/2005 | Brezinski et al. | 166/387 |
| 6,988,557 | B2 * | 1/2006 | Whanger et al. | 166/380 |
| 2003/0121655 | A1 | 7/2003 | Lauritzen et al. | 166/207 |
| 2004/0060706 | A1 | 4/2004 | Stephenson | 166/384 |
| 2004/0112609 | A1 | 6/2004 | Whanger et al. | 166/380 |
| 2004/0118572 | A1 | 6/2004 | Whanger et al. | 166/384 |
| 2005/0199401 | A1 | 9/2005 | Patel et al. | |

FOREIGN PATENT DOCUMENTS

| | | |
|---|---|---|
| EP | 0 629 259 | 4/1997 |
| EP | 1 479 871 | 11/2004 |
| GB | 2 371 064 | 7/2002 |
| GB | 2 396 635 | 6/2004 |
| GB | 2 396 869 | 7/2004 |
| WO | WO 02/20941 | 3/2002 |
| WO | WO 02/25059 | 3/2002 |
| WO | WO 02/059452 | 8/2002 |
| WO | WO 2005/052308 | 6/2005 |

OTHER PUBLICATIONS

Office Action dated Feb. 3, 2006, Canadian Patent Application No. 2,457,294.

* cited by examiner 16
14
49
48
34a
36a
32a
26
46
44
50
28
30
34b
36b
32b
51

SEAL

CROSS-REFERENCE TO RELATED APPLICATIONS

This application claims benefit of Great Britain patent application serial number GB 0303152.3, filed Feb. 12, 2003, which is herein incorporated by reference.

This application is a continuation-in-part of U.S. patent application Ser. No. 10/443,442, filed May 22, 2003, now U.S. Pat. No. 6,988,557 which is herein incorporated by reference.

BACKGROUND OF THE INVENTION

The present invention relates to a seal. In particular, but not exclusively, the present invention relates to a seal for sealing at least part of a wall of a well borehole. In addition, the present invention relates to a sealing apparatus for sealing at least one flow port in an expandable downhole tubular.

FIELD OF THE INVENTION

In the oil and gas exploration and production industry, boreholes are drilled through rock formations to gain access to hydrocarbon-bearing formations, to allow the hydrocarbons to be recovered to surface. During drilling of a typical borehole, which may be several thousand feet in length, many different rock formations are encountered.

Geological surveys are carried out both before drilling and at various stages during the drilling procedure to determine physical characteristics of the rock formations. Often, rock formations having problematic physical characteristics, such as high permeability, may be encountered. This can cause various problems such as allowing unwanted water or gases to enter the borehole; crossflow between high and low pressure zones; fluid communication between a highly permeable formation and adjacent formations; and where a sub-normal or over-pressured formation is sealed off, the permeability of the formation may be such that high pressure fluids permeate upwardly, re-entering the borehole at a different location.

Rock formations can also become damaged during drilling of a borehole, for example, due to the forces exerted on the rock by a drilling bit and the pressurised drilling fluid used in the drilling operation. In these situations, drilling fluid can be lost into the formation, which is detected at surface by a drop in pit volume of the drill fluid. Pit volume is the known volume of drill fluid in surface tanks. As a borehole is extended, this volume goes down by a known amount. Losses above and beyond this reduction due to loss of drilling fluid can therefore be detected. In certain situations, drilling may be halted, the drill string pulled and remedial action taken to stabilise the rock formation, for example, to prevent further loss of drilling fluid. This is because, in this case, it is preferred not to conduct further drilling whilst drilling fluid is being lost into the formation. Furthermore, drilling fluids are typically very expensive and are re-circulated and cleaned for use in subsequent drilling procedures, therefore loss of high quantities of drilling fluid is unacceptable.

Conventionally, these problems have been overcome by running in a length of casing, suspended from the wellhead and cementing the casing in place, to effectively seal off and isolate the damaged formation. However, running and cementing an additional casing string is a time-consuming and expensive solution to the problem.

Furthermore, a drilling procedure is carefully planned and, typically, a borehole is drilled to a specified depth, logging procedures are carried out to determine further characteristics of the rock formation and the drilled borehole is then cased and cemented. The borehole is then extended by drilling a smaller diameter hole from the bottom of the cased section to a second depth and the borehole is again logged and cased with a slightly smaller diameter casing. Thus, each time the drilling procedure is halted and a casing run-in, the internal diameter of the borehole is reduced.

Accordingly, if a problematic formation is unexpectedly encountered and it becomes necessary to carry out a remedial operation by inserting smaller diameter casing earlier than planned, this may restrict the final internal diameter of the borehole. Although this may be allowed for during planning, it is generally undesired and several such occurrences may cause a reduction in final bore diameter, with a critical effect on the future production of hydrocarbons from the well.

Furthermore, even where a solid tubing has been located to seal off a problematic formation, problems may remain. For example, a reduction in casing shoe integrity can cause fluid ingress or egress. A casing shoe is the last section of a string of casing and, during completion of a well, a liner is typically located extending from the shoe of a larger diameter casing. The formation adjacent the casing shoe/liner interface may be a weak point and vulnerable to damage and potential fracture. This can cause a loss in pressure integrity, leading to fluid ingress or egress.

Also, gas migration may occur behind a pipe such as a borehole liner, even where a liquid pressure seal is provided during cementing between the pipe and the borehole wall. Such gas migration may cause gas to enter the bore at an undesired location.

In recent years, a great deal of research has been conducted in the industry into expandable tubing technologies. In particular, expandable sand exclusion tubing, such as that disclosed in International patent publication no WO97/17524 (Shell), and as sold under the ESS trademark by the present applicant, has been developed for solving problems involving sand production. The ESS tubing prevents sand from entering a lined bore, avoiding the requirement to separate sand from produced fluids, and the tendency of sand to block the bore and cause accelerated wear of downhole components. Often ESS tubing is run on solid tubing, located in a production zone of a borehole, and diametrically expanded to provide a simple method of recovering well fluids whilst separating any sand from the produced fluids. However, it can be more difficult to achieve effective zone isolation when setting the ESS tubing string in a borehole in the above described situations. In particular, known downhole packers are not expandable and may not inflate sufficiently to seal against a borehole wall in the open hole environment.

Additionally, certain types of downhole tubulars include flow ports/apertures for fluid flow through a wall of the tubular. Problems exist in sealing the flow port where the tubular is expandable, as conventional sealing arrangements (such as valves and the like) are not expandable and cannot be used with such tubulars.

It is amongst the objects of embodiments of the present invention to obviate or mitigate at least one of the foregoing disadvantages.

SUMMARY OF THE INVENTION

According to a first aspect of the present invention, there is provided an expandable seal for sealing at least part of a wall of a well borehole, the expandable seal comprising:

an expandable tubular support member; and an inflatable seal element mounted externally of the expandable tubular support member for inflation radially outwardly into sealing engagement with at least part of the wall of the well borehole.

According to a second aspect of the present invention, there is provided an expandable seal assembly for sealing at least part of a wall of a well borehole, the assembly comprising:

first and second spaced expandable seals for sealing engagement with the wall of the well borehole at spaced locations, each expandable seal comprising an expandable tubular support member and an inflatable seal element mounted externally of the expandable tubular support member for inflation radially outwardly into sealing engagement with the well borehole wall.

The assembly may further comprise an expandable tubular extending between the first and second spaced expandable seals.

The invention provides an expandable seal which may be used for sealing an open hole, that is, one which has not yet been lined with casing, liner or other tubing. Open holes have irregular bore walls which cannot be sufficiently sealed using existing, known sealing techniques. The seal has particular uses in formations having a tendency to Awash out@ (deteriorate under pressure of circulated drilling fluid); boreholes that have irregular hole sizes; and formations that are soft, unconsolidated or have high vertical permeability. This is because inflation of the seal element into contact with a borehole wall provides a greatly enhanced seal load on the formation. Furthermore, as the seal includes an expandable tubular support member, it is possible to set the seal in a borehole whilst minimising or avoiding reduction in the internal diameter of the borehole. Also, the expandable seal assembly may be used to seal off and isolate part of a well borehole from the remainder of the borehole. Thus, for example, where a particular zone of the borehole, such as a particular rock formation, has become damaged or is highly permeable, this zone may be isolated from the remainder of the borehole.

Preferably, the expandable seal is adapted for sealing at least part of an unlined well borehole. Alternatively, the expandable seal may be for sealing a tubing lined borehole, which may be lined with casing, liner or other tubing.

The seal may further comprise at least one chamber, and may comprise a plurality of chambers adapted for inflation to urge the seal element radially outwardly, and the chamber may be located radially inwardly of the seal element. Thus, when the chamber is inflated the seal element is inflated and urged radially outwardly. The chamber may be annular and may be at least partially defined by the seal element and the support member.

Preferably, the seal element is expandable such that expansion of the support member also expands the seal element. This may bring the seal element into contact with the borehole wall to provide at least a partial seal.

Preferably, the seal further comprises a filler material adapted for maintaining the seal element inflated and in sealing engagement with the borehole. The seal chamber may contain the filler material. The filler material may be adapted to react with a selected reactant to swell, solidify or otherwise maintain the seal inflated. The filler material may comprise a solid material and is preferably a granular solid material. The seal may be inflatable by supplying a fluid to the seal, and the fluid may comprise a reactant for reacting with the filler material to form a single, solid member, or a viscous mass. The filler material may comprise a mixture of bentonite (absorbent aluminium silicate clay) and a water soluble polymer such as polyacrylamide, as disclosed in U.S. Pat. No. 3,909,421, the disclosure of which is incorporated herein by way of reference. When mixed with water as a reactant fluid, a clay is formed and the water soluble polymer flocculates and congeals the clay to form a much stronger and stiffer cement-like plug. Various other filler materials, such as those disclosed in U.S. Pat. Nos. 4,633,950; 4,503,170; 4,475,594; 4,445,576; 4,442,241 and 4,391,925, the disclosures of which are incorporated hereby by way of reference, may alternatively be employed. The reactant may comprise water, an aqueous solution, a drilling fluid such as drilling mud, production fluid, or any other suitable fluid or fluid mixture. In alternatives, any other suitable material or method may be employed for maintaining the seal element inflated, such as a cement or other hardenable material or a gelatinous material.

Preferably, the seal element is elastically deformable. This ensures that the seal element is relatively easily expanded and also provides for good sealing engagement with the borehole. The seal element preferably comprises an elastomeric material. Such materials have good sealing capabilities. Most preferably, the seal element comprises a natural rubber or a Aswelling@ elastomer which swells in contact with water or hydrocarbons by absorption. Thus, in the downhole environment where water and hydrocarbons are present, this provides improved seal function of the seal element over time as water/hydrocarbons are absorbed. Alternatively, any other suitable material such as a plastics material may be employed.

The support member may include at least one aperture for fluid communication between the seal element and the interior of the support member. Thus, fluid can flow from the support member, through the apertures and to the seal element to allow reaction of the filler material with the reactant. Preferably, the support member includes a plurality of apertures, and each aperture may comprise a hole of circular, oval, square, rectangular or other desired shape.

The support member may also include a plug for closing the aperture and where there are a plurality of apertures, a plug for each aperture. The plug initially closes the aperture to isolate the seal element, preventing fluid communication between the seal element and the interior of the support member. The aperture may be openable by deformation or fracture of the plug, for example, by expansion of the support member. The plug may be hollow and may include a cap for closing the aperture, the cap being removable to allow fluid flow through the plug. The plug may extend into the bore of the support member and the cap may be removed on expansion of the support member or in a separate procedure. Alternatively, the plug may be adapted to be pulverised or crushed to open the aperture, for example, on expansion of the support member, and may be of a ceramic or other suitable material.

Additionally or alternatively, the plug may be removable. The plug may be adapted to releasably engage the aperture. For example, the aperture may be threaded and the plug may be threaded for engaging the aperture. On expansion of the support member, the aperture may be deformed causing the plug to become disengaged, allowing fluid flow. Alternatively, the plug may engage the aperture in a friction fit, or may carry a snap ring or the like for engaging a groove in a wall of the aperture in a snap-fit. The plug may likewise disengage the aperture on expansion.

The support member may be at least partly slotted and may at least partly comprise slotted tubing. In tubing of this type, the slots open up during expansion to form apertures which may typically, but are not required to be generally square or diamond shaped, depending upon the nature of the slots present in the unexpanded support member.

The seal may further comprise a screen member provided between the seal element and the support member. The screen member may be provided between the chamber and the support member. This prevents escape of filler material. Where the filler material comprises a granular solid, a pore or mesh size of the screen member may be smaller than or at most equal to the average grain size of the granular material. This ensures that the granular material cannot escape. It will be understood that following mixture with the reactant and before the reaction takes place, the resultant solids/fluid mixture is heavily laden with the filler material, and the mixture is thus of a grain size greater than the screen mesh size and cannot escape through the screen member.

The seal may further comprise at least one reinforcing member for reinforcing the seal element to support the seal element during inflation. The seal may include a reinforcing member at each end of the seal element to contain inflation of the seal element. The reinforcing member may contain the inflation pressure acting to inflate the seal element. The reinforcing members may comprise ribs, fingers, a collar or the like mounted between the support member and the seal element, and may be of a metal composite, carbon fibre, or other suitable material. The reinforcing member may be integral or separate from the seal element.

The expandable tubular extending between the first and second seals may comprise a perforated tubular such as an expandable sandscreen as disclosed in International Patent Publication No. WO97/17524 (Shell). Alternatively, the expandable tubular may comprise a solid expandable tubular. The expandable tubular may comprise a plurality of lengths of tubing coupled together.

The seal may include a sandscreen or an alternative perforated screen or the like located around the seal element, the sandscreen adapted to be expanded at least in part by inflation of the seal element. This allows a precise expansion of the sandscreen in a desired location by inflation of the seal element. The seal assembly may comprise a sandscreen located around the seal elements. Thus where the seal assembly comprises a number of seals, a selected one or more seals may be inflated to expand the sandscreen in a desired location or number of locations. It will be understood that the sandscreen may extend over a long section of a borehole and that this allows precise expansion of the sandscreen into contact with the borehole wall at one or a number of desired locations.

According to a third aspect of the present invention, there is provided an expandable seal assembly for sealing at least part of a wall of a well borehole, the assembly comprising:

first and second spaced expandable seals for sealing engagement with the wall of the well borehole at spaced locations, each expandable seal comprising an expandable tubular support member and an inflatable seal element mounted externally of the expandable tubular support member for inflation radially outwardly into sealing engagement with the well borehole wall; and an expandable sandscreen extending between the first and second spaced expandable seals.

The sandscreen may comprise a sandscreen as disclosed in International Patent Publication No. WO97/17524. The sandscreen may comprise an inner expandable support tubing, an outer expandable protective tubing and a filter screen sandwiched between the inner and outer tubing. The filter screen may comprise overlapping filter sheets coupled along an axial edge to the inner tubing. The sandscreen may thus comprise the applicant=s commercially available expandable sand exclusion tubing, sold under the ESS trade mark. Preferably, the assembly further comprises a solid tubular coupled to one of the first and second expandable seals, and may comprise a solid tubular coupled to both the first and second seals. Coupling solid tubular to the seals allows isolation of a formation when using an assembly including an expandable sand exclusion device. The solid tubular is preferably expandable. This minimises restriction of the borehole diameter. The assembly may comprise a plurality of expandable seals and a plurality of expandable sandscreens. Sections of sandscreen may be coupled together to form a string with seals spaced along a length of the string. This allows the sandscreen to be provided across a relatively large formation or a long portion of the borehole wall. There may be a number of lengths of sandscreen provided alternately between lengths of solid tubular. This allows isolation of a number of separate parts of the borehole wall.

According to a fourth aspect of the present invention, there is provided a method of sealing at least part of a well borehole, the method comprising the steps of:

locating an expandable seal in the well borehole;

expanding a tubular support member of the expandable seal; and inflating a seal element mounted on the tubular support member radially outwardly into sealing engagement with the well borehole.

The method may comprise locating a sandscreen or the like around the seal and expanding the sandscreen by inflating the seal element.

According to a fifth aspect of the present invention, there is provided a method of sealing at least part of a well borehole, the method comprising the steps of:

coupling first and second expandable seals to opposite ends of an expandable tubular to form an expandable seal assembly;

locating the expandable seal assembly in the well borehole;

expanding tubular support members of the first and second expandable seals; and inflating seal elements mounted on the tubular support members radially outwardly into sealing engagement with the well borehole.

Preferably, the seal is located in an unlined borehole, to allow sealing in an open hole. Alternatively, the seal may be located in a tubing lined borehole such as within casing, liner or other tubing. Thus, for example, the seal may be located in a deteriorated casing or lining.

Preferably, the support member is mechanically expanded. For example, a tubing expansion tool such as that disclosed in the Applicant's earlier International Patent Publication No. WO00/37766 may be run through the seal assembly for expanding the tubular support member and the seal element. The seal element may also be expanded when the support member is expanded.

The seal element may be inflated by supplying a fluid under pressure to the seal element. The fluid may be supplied to a chamber between the support member and the respective seal element. The fluid may be pressurised above ambient pressure in the region of the seal. Preferably, the fluid is pressurised above the pore pressure of the adjacent formation.

The method may further comprise maintaining the seal element in sealing engagement with the borehole. The fluid may react with a filler material which may be provided in a chamber of the seal and which may comprise a granular material, to form a single solid or viscous mass maintaining the seal element inflated.

A plurality of the seals may be coupled together to form a string of expandable seals. The seal string may be used for sealing over a relatively large length of borehole, for example, to provide enhanced sealing in a particularly problematic formation.

The expandable tubular may also be expanded. In this fashion, restriction of the borehole diameter is minimised following expansion.

The borehole may be underreamed, drilled to a larger diameter or otherwise enlarged prior to location of the seal in the borehole. In this fashion, following expansion of the seal, the minimum internal diameter of the seal is sufficient to allow further drilling of the borehole whilst minimising reduction in bore diameter.

The method may comprise locating a sandscreen or the like around the seal and expanding the sandscreen by inflating the seal element.

Further features of the seal, seal assembly and method are defined in the attached claims.

According to a still further aspect of the present invention, there is provided a sealing apparatus for sealing at least one flow port in an expandable downhole tubular, the sealing apparatus comprising:

a sealing member coupled to the expandable tubular, the sealing member including a deformable portion movable between a closed position preventing fluid flow through the flow port and an open position permitting fluid flow through the flow port.

Preferably, the sealing member is adapted to be expanded on expansion of the expandable tubular.

The deformable portion is preferably elastically deformable such that, in the absence of an applied opening force, the deformable portion is urged towards the closed position. Alternatively, the deformable portion may be plastically deformable.

The deformable portion may be movable between the closed and open positions in response to an applied fluid pressure force. In particular, the deformable portion may be adapted to move to the open position in response to an applied fluid pressure force of a determined magnitude. Thus the flow port may open automatically on the deformable portion being exposed to fluid at a pressure which generates a fluid pressure force at said determined magnitude.

Preferably, the sealing member is mounted externally of the expandable tubular, and may be secured to an outer surface of the tubular. The sealing member may be of a material having a higher Young's modulus (elasticity) than the expandable tubular. Thus following expansion of the tubular and the sealing member, the engagement between the sealing member and the tubular may effectively be enhanced. This is because there would be a greater elastic recovery of the outer sealing member relative to the inner expandable tubular. This may ensure continued effective operation of the sealing member post expansion.

Alternatively, the sealing member may be mounted internally of the expandable tubular, and may be secured to an internal surface of the tubular. The sealing member may be of a material having a lower Young's modulus (elasticity) than the expandable tubular. Thus following expansion of the tubular and the sealing member, the engagement between the tubular and the sealing member may effectively be enhanced. This is because there would be a greater elastic recovery of the outer, expanded tubular relative to the inner sealing member. This may ensure continued effective operation of the sealing member post expansion.

The sealing member may be annular and may have an end adapted to be secured to the expandable tubular, for example by welding or the like. The other end of the sealing member may define the deformable portion and may be adapted to be coupled to the expandable tubular in an interference fit. The deformable portion may thus define a free end adapted to move between closed and open positions to open and close the flow port.

Preferably, the sealing member is adapted for sealing a plurality of flow ports, which may be spaced around a circumference of the expandable tubular and/or along a length of the expandable tubular. The sealing member may be tubular and may define a sleeve.

The sealing apparatus may have a particular utility for sealing a flow port in an expandable tubular forming part of a seal described herein. However, it will be understood that the sealing apparatus has a general utility for sealing a flow port in any type of expandable downhole tubular.

BRIEF DESCRIPTION OF THE DRAWINGS

Embodiments of the present invention will now be described, by way of example only, with reference to the accompanying figures, in which.

DETAILED DESCRIPTION OF DRAWINGS

Figure 1:
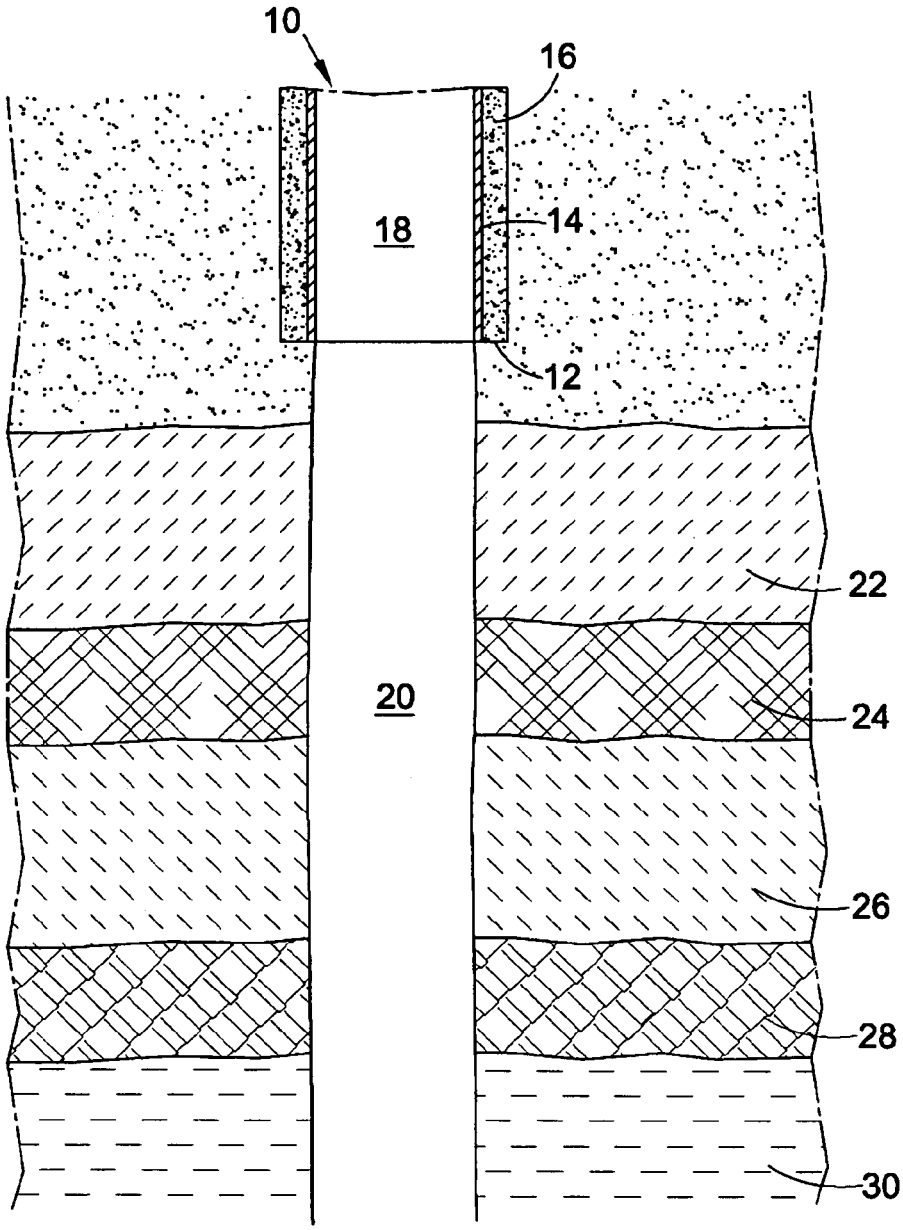
FIG. 1 is a schematic cross-sectional illustration of a step in the procedure of drilling and casing a borehole.

Referring firstly to FIG. 1, there is shown a schematic illustration of a step in the procedure of drilling and casing a borehole 10. The borehole 10 is initially drilled to a first depth 12 and logged to determine certain geological characteristics of the rock formations in the region of the borehole. A casing 14 has then been installed and cemented at 16 in an upper section 18 of the borehole 10, which extends to surface. The borehole 10 is then continued by drilling a smaller diameter borehole section 20 beyond the end of the casing 14 through a number of rock formations illustrated at 22-30.

In this example, during drilling of the section 20, the rock formation 28 has unexpectedly been found to be highly permeable, and drilling fluid has been lost into the formation 28. Loss of drilling fluid is detected by a drop in the pit volume of drilling fluid and drilling procedures have been suspended.

To prevent further loss of drilling fluid into the formation 28 and to allow well completion procedures to be subsequently carried out, a seal assembly according to an embodiment of the invention is to be located in the section 20 straddling the formation 28, as will be described below.

Figure 2:
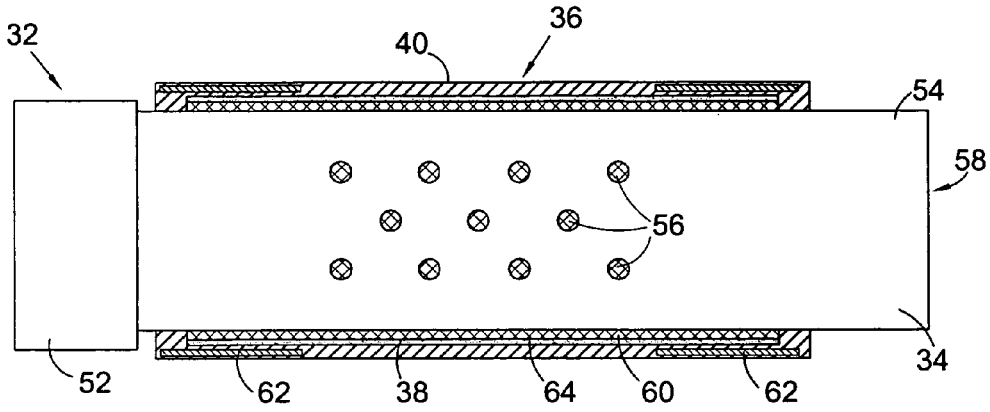
FIG. 2 is a longitudinal, partial sectional view of a seal in accordance with an embodiment of the present invention, shown in an unexpanded configuration.

Turning now also to FIG. 2, there is shown a seal in accordance with a preferred embodiment of the present invention, the seal indicated generally by reference numeral 32. The seal assembly incorporates two such seals, one of which will be described in detail below. The seal 32 includes a diametrically expandable support tube 34, and an inflatable seal element in the form of a seal tube 36, mounted on the support tube 34. The seal tube 36 is typically of an elastomeric material such as a swelling elastomer, or of rubber materials including natural rubber. Only the seal tube 36 is shown in section in the figure, for illustration purposes. A chamber 38 is defined between the seal tube 36 and the support tube 34. In use, the support tube 34 is expanded to bring the seal tube 36 closer to or possibly into contact with the wall of the borehole section 20, depending on factors including the dimensions of the borehole. The seal 32 is then inflated by inflating the chamber 38, to urge the wall 40 of the seal tube 36 radially outwardly into sealing engagement with the wall of the borehole section 20. As will be described, location of the seal 32 allows the rock formation 28 to be straddled and isolated, preventing further loss of drilling fluids.

Figure 3:
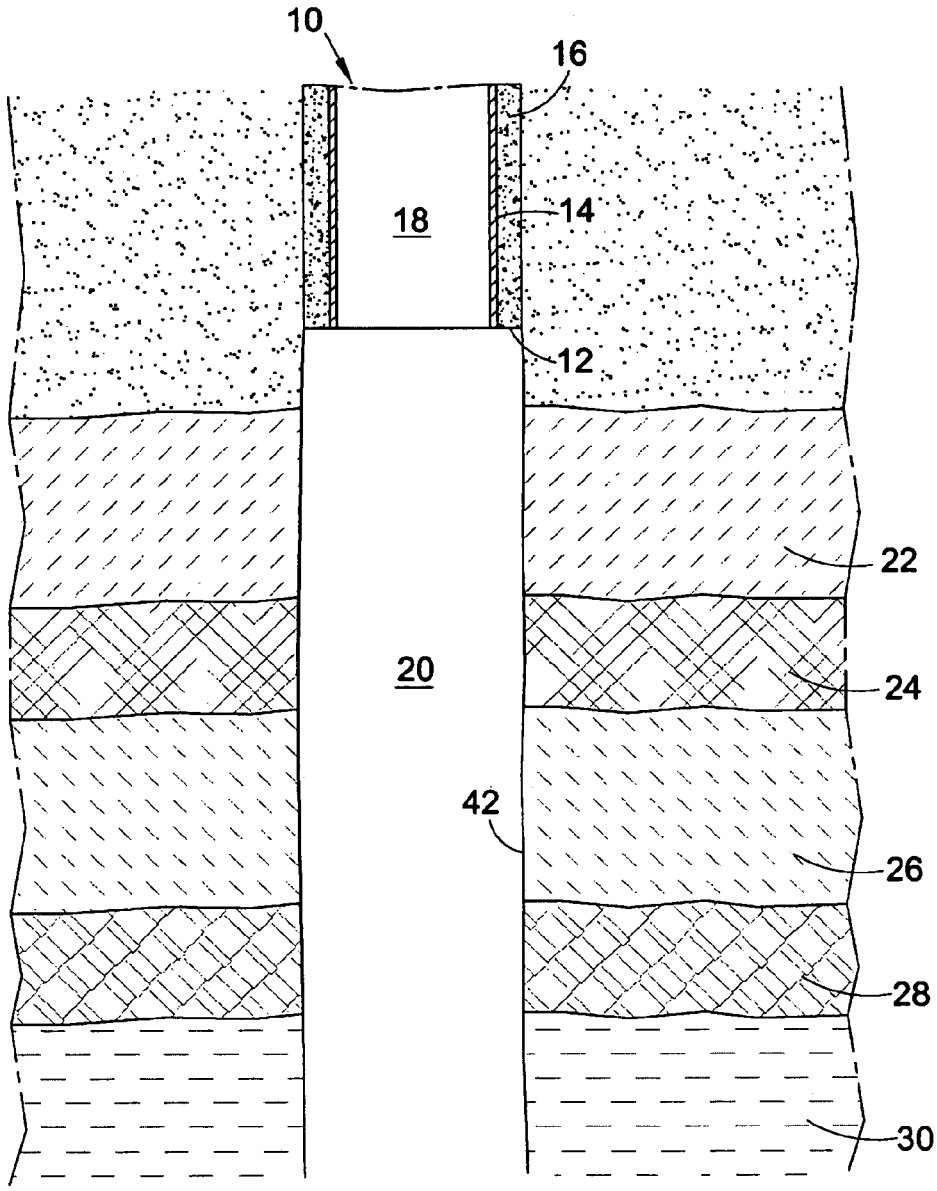
FIG. 3 is a view of the borehole of FIG. 1 following an underreaming procedure.
Figure 4:
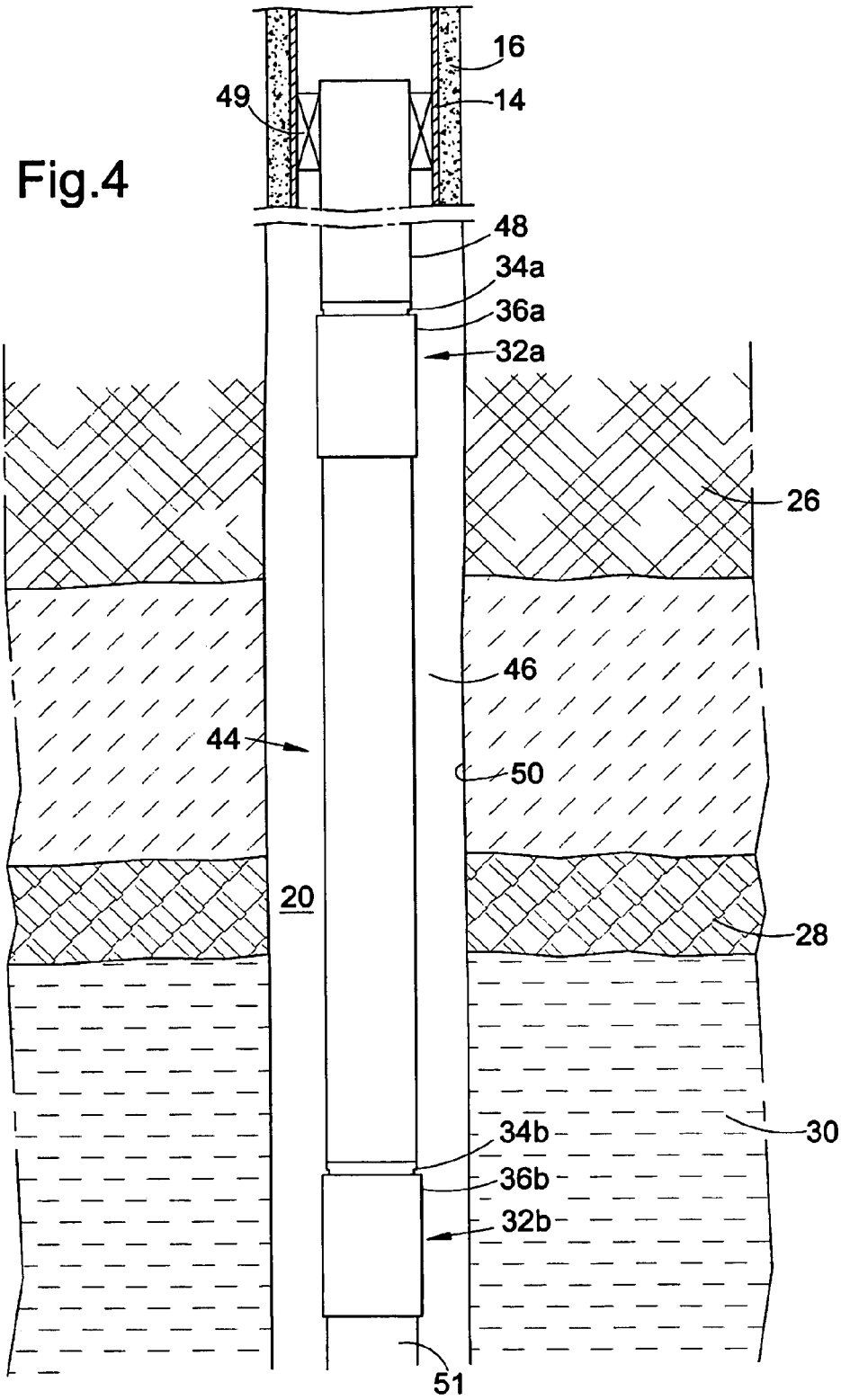
FIG. 4 is an enlarged view of a portion of the borehole of FIG. 3 following location of a seal assembly in accordance with an embodiment of the present invention, incorporating the seal of FIG. 2, the seal assembly shown in an unexpanded configuration.

The seal 32 is located in the borehole 10 as follows. Once it has been determined that the rock formation 28 is causing loss of drilling fluid, the borehole section 20 is firstly underreamed at 42, as illustrated in FIG. 3, to a larger bore diameter across the rock formation 28, and a seal assembly including the seal 32 of FIG. 2 is located in the borehole to isolate the rock formation 28. The seal assembly 44 is shown in FIG. 4, and includes an upper seal 32*a* coupled to a lower seal 32*b* by an expandable solid tubular 46, made up of connected expandable tubing sections. Each of the seals 32*a* and 32*b* are of the same construction as the seal 32 shown in FIG. 2, and like components share the same reference numerals with the addition of suffixes a, b respectively. The assembly 44 is run into the borehole 10 on a string of expandable solid tubing 48 and is located in the underreamed section 42. The tubing 48 is suspended from the upper casing 14 by a conventional hanger/packer assembly 49, allowing location of the seal assembly 44 in the borehole section 20. Further expandable tubing 51 extends from the lower seal 32*b* deeper into the borehole.

A tubing expansion tool such as that disclosed in the applicant=s earlier International patent publication No. WO00/37766 is then run and located in the tubing 51 below the seal 32*b*. The expansion tool is then activated and translated axially through the seal assembly 44 in a bottom-up or top-down expansion procedure, to diametrically expand the seal assembly 44 and the tubing 48 to a level below the cemented casing 14. It will be understood that part of the tubing 51 and indeed further assemblies downhole of the seal assembly 44 may also be expanded.

Figure 5:
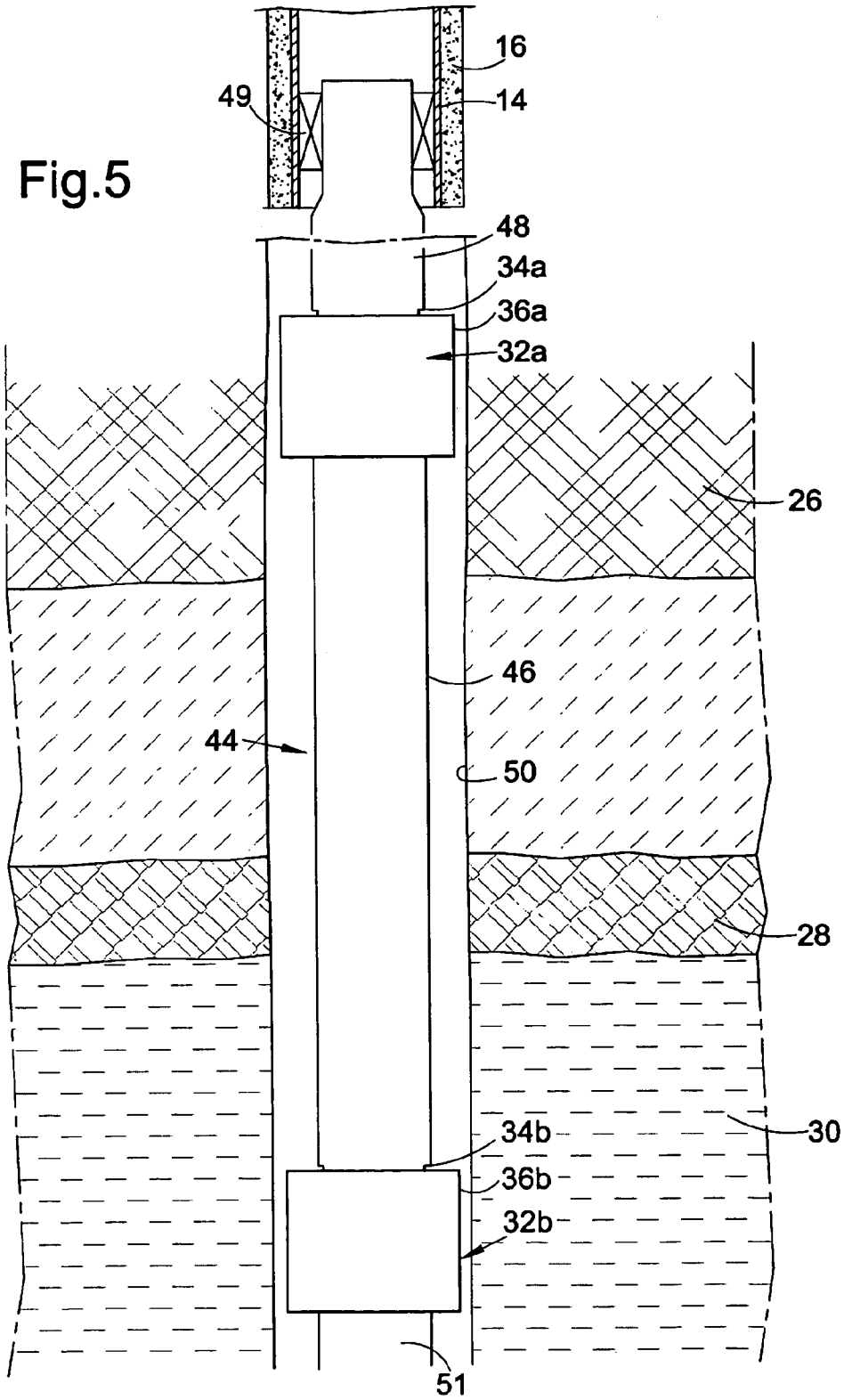
FIGS. 5 and 6 are views of the seal assembly of FIG. 4 shown in an expanded, uninflated and an expanded, inflated configuration, respectively.

Expansion of the assembly 44 brings the seals 32*a* and 32*b* closer to the borehole wall 50, and the tubular 46 is also diametrically expanded. Once the whole seal assembly 44 has thus been fully expanded, as shown in FIG. 5, the expansion tool is deactivated, pulled out and recovered to surface.

Figure 6:
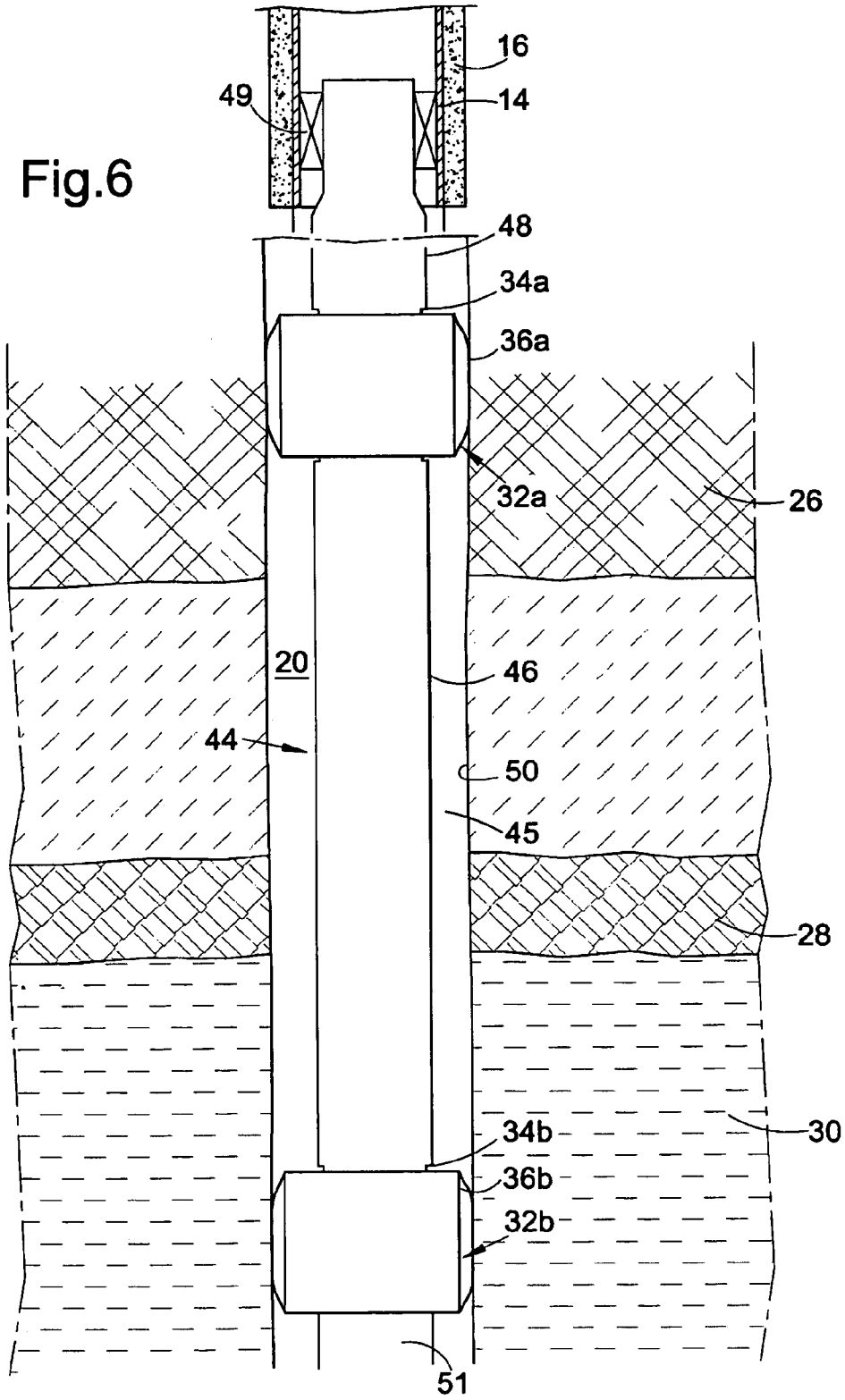

The respective chambers 38*a*, 38*b* of the seals 32*a*, 32*b* are then inflated as shown in FIG. 6, to inflate the seal tubes 36*a*, 36*b* radially outwardly into sealing engagement with the walls of impermeable rock formations 26, 30 respectively. This generates a seal load against the formations such that the annulus 45 between the borehole wall 50 and the assembly 44 is sealed, isolating the rock formation 28 and preventing loss of further fluids into the formation 28.

The seal 32 and its method of operation will now be described in more detail with reference to FIG. 2 and FIGS. 7-9, which show various stages during the expansion and inflation of the seal 32. It will be noted that FIG. 2 has been reproduced at sheet 7 of the drawings for ease of reference and comparison with FIGS. 7-9. The following description applies equally to the seals 32*a*, 32*b*.

As shown in FIG. 2, the support tube 34 includes an upper threaded box 52 for coupling to the tubing 48, and a lower end 54 forming a male threaded pin for connection to the expandable tubular 46. The support tube 34 also includes a number of apertures 56 which allow fluid communication between the support tube interior 58 and the inflatable chamber 38, and a screen 60 is attached to the exterior of the support tube 34 and extends over the apertures 56. The apertures 56 are each threaded and a corresponding threaded plug (not shown) is engaged in each aperture to initially isolate the chamber 38, preventing fluid communication with the support tube bore 58. This prevents premature inflation of the seal tube 36.

Each plug is hollow and includes an end cap which protrudes into the support tube bore 58. Thus, on expansion of the support tube 34, the end caps are sheared off, allowing fluid flow through the hollow portions of the plugs for subsequent inflation of the seal tube 36. Additionally, as will be described below, the apertures 56 are deformed on expansion, tending to cause the plugs to disengage the apertures and to fall out, opening the apertures.

Figure 9:
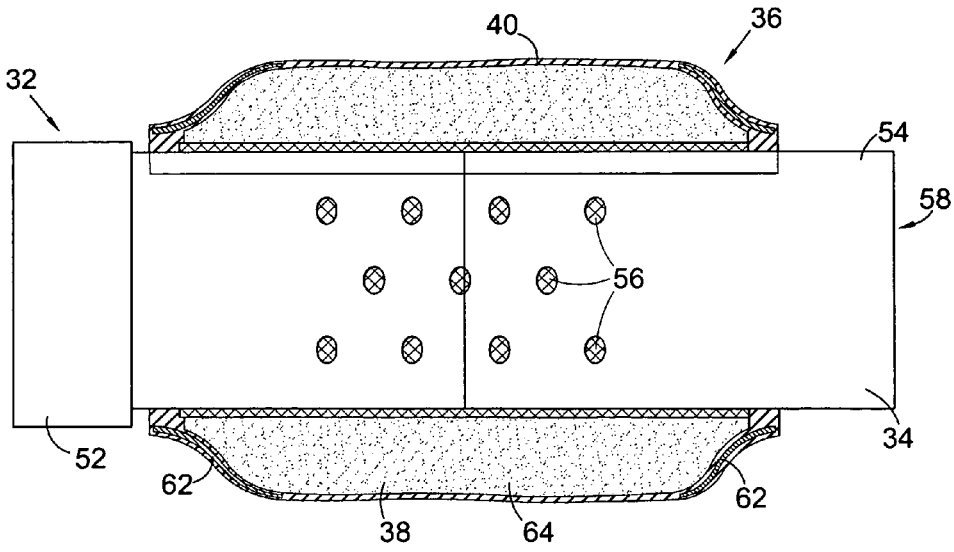

As discussed above, the seal tube 36 is of an elastomeric material or a rubber such as a natural rubber and a series of reinforcing ribs 62 are provided integrally with and at opposite ends of the seal tube 36 to provide structural support. The ribs 62 contain the inflation pressure of the seal 36 when inflated, as shown in FIG. 9 and may be metal, composite, carbon-fibre or the like.

The outer wall of the chamber 38 is defined by the seal tube 36 and the chamber 38 is in fluid communication with the support tube bore 58 through the screen 60 and apertures 56. A solid granular filler material 64 is provided in the chamber 58 and the average grain size of the filler is at least equal to the mesh size of the screen 60. This prevents the granular filler from passing through the apertures 56 into the support tube bore 58. The filler material typically comprises a mixture of bentonite (absorbent aluminium silicate clay) and a dry, powdered water soluble polymer such as polyacrylamide, as disclosed in U.S. Pat. No. 3,909,421 the disclosure of which is incorporated herein by way of reference.

Figure 7:
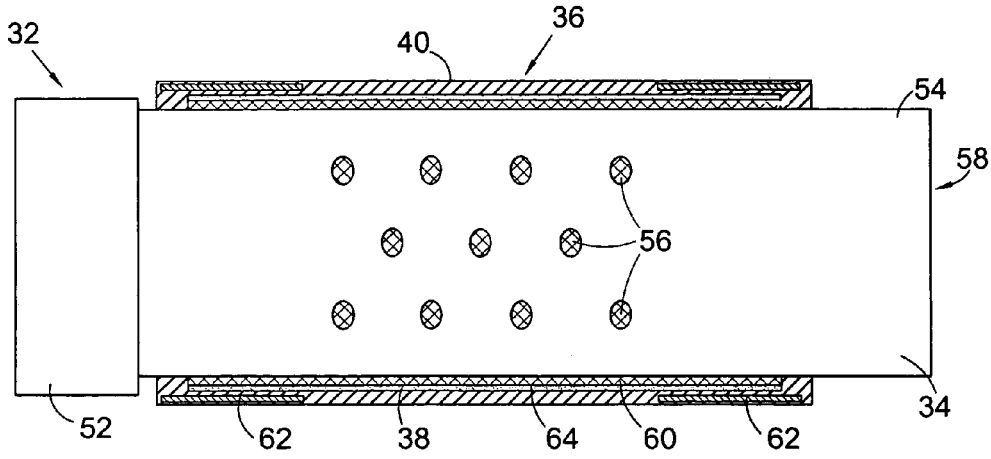
FIGS. 7-9 are views of the seal of FIG. 2 shown during various stages in a procedure for expanding and inflating the seal (FIG. 7 on same sheet as FIG. 2)

Following location of the seal assembly 44 in the borehole 10 as shown in FIG. 4, the expansion tool is run through the seals 32*a*, 32*b*, as described above. The support tubes 34*a*, 34*b* are thus expanded to a greater internal diameter, as shown in FIG. 7, causing a corresponding expansion of the seal tubes 36*a*, 36*b*. This brings the seal tube walls 40*a*, 40*b* closer to and possibly into contact with the borehole wall 50, which may therefore provide a partial seal load between the seals 32 and the borehole. This expansion also ovalises the apertures 56*a*, 56*b* of the respective support tubes 34*a*, 34*b* as shown in FIG. 7 and opens the apertures by fracturing the aperture plugs, as described above.

A reactant fluid inert to well and drilling fluids is then supplied to the seals 32, to inflate the chambers 38*a*, 38*b*. The fluid is supplied using an inflation tool such as the applicant=s commercially available Selective Cement Inflation Tool (SCIT), which is run into the lower seal 32*b*, sealing against the support tube 34*b* inner wall above and below the apertures 56*b*. A volume of fluid is then forced under pressure into the chamber 38*b*.

Figure 8:
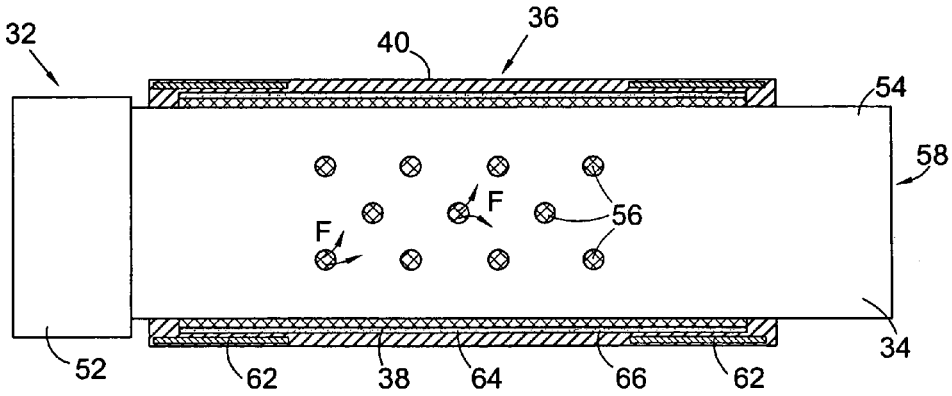

As shown in FIG. 8, the fluid is forced through the apertures 56 in the support tube 34 and into the chamber 38 as indicated by the arrows F. The fluid is pressurised above the pore pressure of the surrounding rock formations and the chamber 38 is inflated as shown in FIG. 9, urging the seal wall 40 radially outwardly. This generates a large pressure-energised seal load between the seal and the adjacent impermeable rock formation.

The reactant fluid which is supplied to the chamber 38 mixes with the filler 64 and the resultant solids-laden fluid 66 cannot pass through the screen 60, as the grain size of the swollen filler 64 remains greater than the screen mesh size. Accordingly, the applied pressure may be relaxed once the seal 32 has been inflated.

The granular filler 64 reacts with the reactant fluid and the resultant mixture solidifies over a period of time, to maintain inflation of the chamber 38 and thus to maintain the enhanced seal load on the borehole wall 50. This procedure is repeated for the upper seal 32*a*, and the annulus 45 is thus sealed, isolating the formation 28 from the borehole 10, preventing further fluid losses.

Where the filler is a bentonite/polyacrylamide mixture, water is used as the reactant fluid. When mixed with water downhole, a clay is formed and the water soluble polymer flocculates and congeals the clay to form a much stronger and stiffer cement-like plug. Various other filler materials, such as those disclosed in U.S. Pat. Nos. 4,633,950; 4,503,170; 4,475,594; 4,445,576; 4,442,241 and 4,391,925, the disclosures of which are incorporated hereby by way of reference, may alternatively be employed.

As the solids/reactant mixture reacts and sets, the mixture may lose bulk volume. This loss of volume may be offset in several ways. Firstly, seal tube 36, where of a material such as a swelling elastomer or a natural rubber, adsorbs hydrocarbons (well fluids) or other fluids over a period of time and tends to expand. This further expansion of the seal tube 36 enhances the seal load on the rock formation over time.

Secondly, in certain situations, for example, where the seal 32 is set in a formation such as an unstable formation tending to collapse inwardly over time, the re-stressed formation will move inwardly towards the seal element 36, to retain the seal load on the formation.

Thirdly, as the seal 32 is inflated to a pressure above the pore pressure of the rock formation, this over pressurisation maintains an effective seal load despite loss of bulk volume.

Fourthly, the relatively high temperatures experienced downhole tend to cause the seal 32 to swell.

In alternative assemblies, the seal assembly 44 may be located in the borehole section 20 in such a way as to avoid or minimise restriction of the borehole. The assembly 44 may be self-hanging by expansion of the seals 32 into contact with the borehole wall. Alternatively, an expandable centraliser may be used to locate and hang the assembly 44 in the borehole.

Following completion of this procedure, the borehole 10 can then be continued to the next desired depth and the next casing run through the assembly 44 and cemented in a similar fashion to the upper casing 14, without any additional reduction in bore diameter.

In further alternatives, the assembly 44 may be hung in an open hole independently of existing casing from a casing patch or using any other suitable method.

Figure 10:
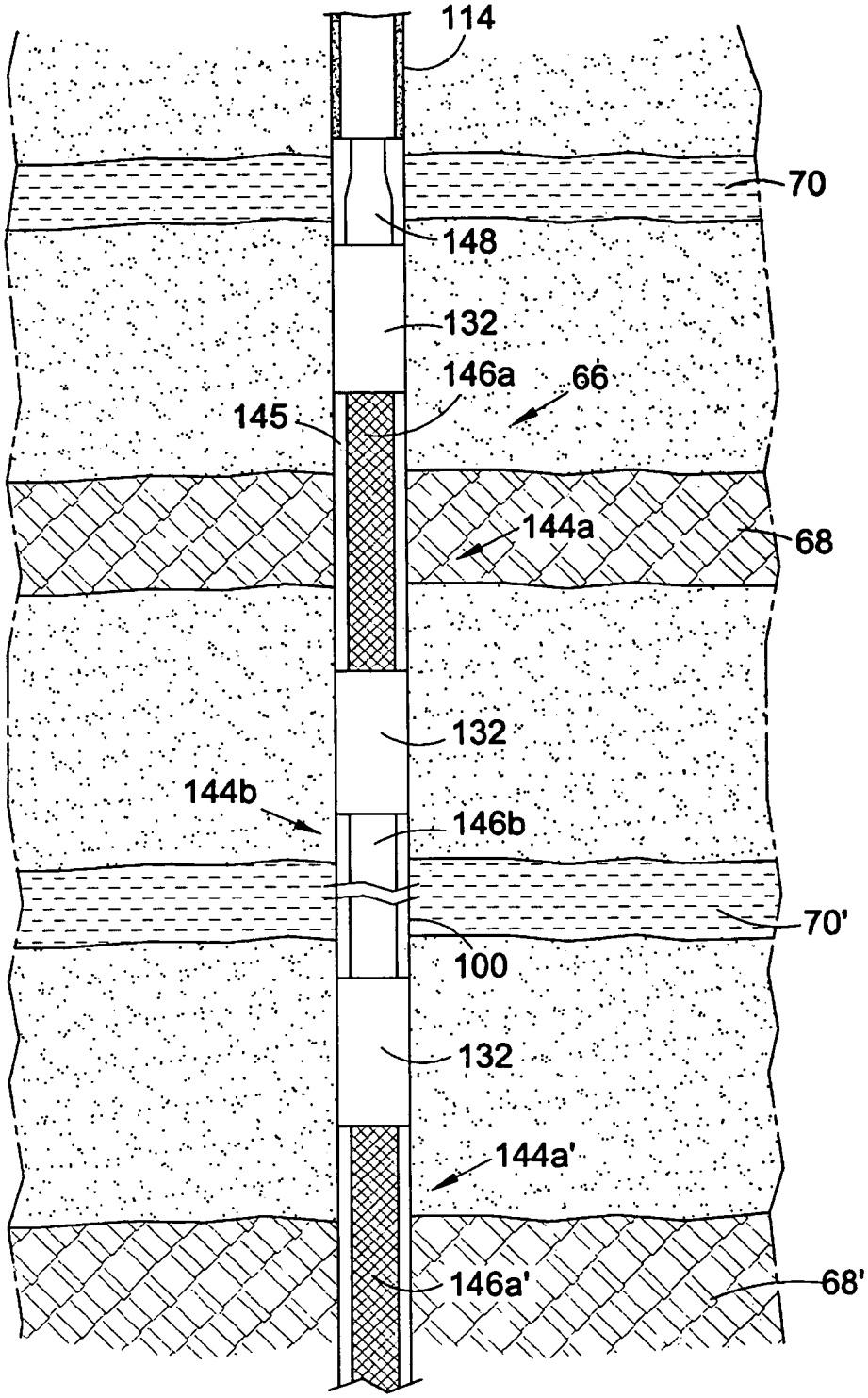
FIG. 10 is a schematic view of a string located in a borehole incorporating seal assemblies including the seal of FIG. 2 and shown in an expanded configuration.

Turning now to FIG. 10, there is shown a schematic view of a tubing string 66 located in a borehole 100, the string 66 comprising a number of assemblies 144 coupled together. Like components of the assemblies 144 share the same reference numerals as the assembly 44 of FIGS. 1-9, incremented by 100. Each assembly generally comprises a tubular 146 and a pair of expandable seals 132.

In more detail, the string 66 comprises a number of sand exclusion tubing-based assemblies 144*a* located alternately between solid expandable tubular assemblies 144*b*. The assemblies 144*a* are each located adjacent a hydrocarbon bearing rock formation, allowing recovery of well fluids through the sand screen. Running sand screen as part of an assembly including the expandable seals 132 allows the tubing to be located in open hole, expanded and the seals 132 inflated to provide sealing with the borehole wall. The string 66 is expanded in a bottom-up or top-down expansion procedure.

As shown in the figure, the uppermost assembly 144*a* is located adjacent a hydrocarbon bearing formation 68. An upper solid expandable tubular 148 extends from casing 114 and is secured by a conventional liner hanger in the casing. The uppermost assembly 144*a* is sealed in the borehole 100 by expanding and inflating the seals 132 against impermeable rock formations above and below the formation 68, ensuring that fluid entering the borehole annulus 145 is directed through the sand screen 146*a* and is thus recovered to surface. The solid expandable assembly 144*b* immediately below the upper sand exclusion tubing-based assembly 144*a* shares the seals 132 of the adjacent sand exclusion assemblies and includes a solid expandable tubular 146*b*. A lower sand exclusion tubing assembly 144*a*=is similarly located adjacent a formation 68'.

Accordingly, each sand exclusion tubing-based assembly 144*a* is located between solid expandable tubulars. In this fashion, the formations 68, 68' adjacent the sand exclusion assemblies 144*a*, 144*a*=are isolated, preventing passage of fluid up the borehole annulus 145 to an alternative location. Furthermore, migration of fluids from the formations 68, 68' along the borehole annulus 145 to non-producing formations is prevented. In a similar fashion the seals 132 also prevent fluid migration along the borehole annulus 145 from water producing zones 70, 70' and through the sand screens 146*a*, 146*a*' of the assemblies 144*a*, 144*a*' placed across hydrocarbon zones 68 and 68', thus isolating the water and allowing production of only the hydrocarbons.

It will be understood that FIG. 10 is a schematic illustration and that the string 66 will typically include multiple lengths of sand exclusion tubing coupled together and extending hundreds or thousands of feet along the length of the borehole 100. A number of seals 132 would be provided spaced along the length of the string.

In an alternative embodiment of the invention, sandscreen such as the applicant's ESS or other perforated tubing may be located around the seal 32. The sandscreen may be expanded on inflation of the seal element 36. An assembly comprising a number of the seals 32 may carry sandscreen along a length of the assembly located around the seals, and the sandscreen may thus be expanded at one or more desired locations by inflation of the chamber of a seal within the sandscreen. Accordingly, the sandscreen can be precisely expanded where required at various locations along the length of a borehole. It will be understood that, to allow fluid flow through the sandscreen into the assembly, the seals or selected ones of the seals may be coupled together by perforated, expandable tubing.

Figure 11:
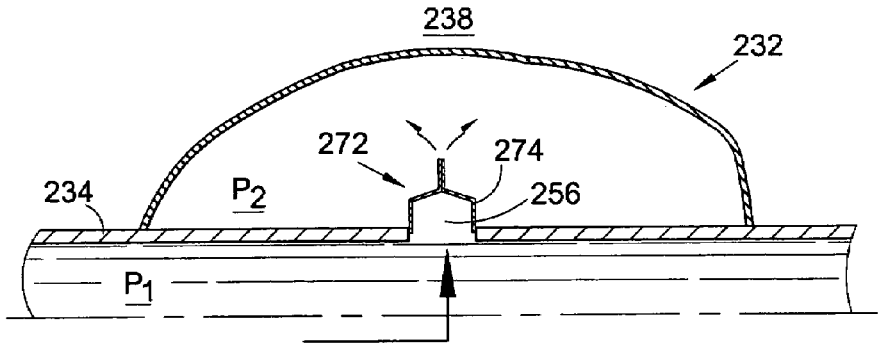
FIG. 11 is an enlarged, schematic cross-sectional view of part of a seal in accordance with an alternative embodiment of the present invention, shown during inflation of the seal.

Turning now to FIG. 11, there is shown an enlarged, schematic cross-sectional view of part of a seal in accordance with an alternative embodiment of the present invention, the seal indicated generally by reference numeral 232. The seal 232 is in fact of similar structure to the seal 32 of FIGS. 1-9, and like components share the same reference numerals, incremented by 200. Only the differences between the seal 232 and the seal 32 will be described herein in detail.

Figure 12:
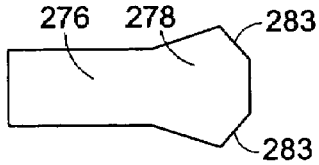
FIGS. 12 and 13 are enlarged top and end views, respectively, of a valve forming part of the seal of FIG. 11.
Figure 13:
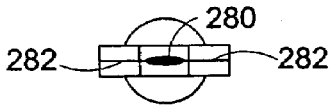

The seal 232 includes a support tube 234 which has a number of apertures 256. In the figure, the inflatable seal tube 236 has been omitted, but part of an inflatable chamber 238 is illustrated. Each aperture 256 includes a respective valve 272, which in the illustrated embodiment takes the form of a generally tubular member, typically of an elastomeric or similar material. The valve 272 is shown in more detail in the top and end views of FIGS. 12 and 13, and includes a tubular portion 276, which is secured to the aperture 256, and a flattened portion 278. As best shown in FIG. 13, the flattened portion 278 is formed by securing opposite sides of the valve wall 274 together at 280, using an adhesive or by fusing. This leaves two channels 282 either side of the securing 280, along which fluid may flow between the interior of the support tube 234 and the chamber 238. To assist fluid flow, the corners 283 of the flattened portion 278 are removed.

The valve member 272 is thus provided in the chamber 238 and is sealed to the support tube 234. By making the valve member 272 of an elastomeric or similar material, enlargement of the opening 256 on expansion of the support member 234 is accounted for.

The valve 272 is initially closed as the pressure P2 of fluid in the chamber is equivalent to the external borehole pressure, which is greater than the pressure P1 of fluid in the support tube 234. This closes the channels 282. When it is desired to inflate the seal tube, fluid is supplied under pressure to the seal 232, for example, in the fashion described above. The fluid pressure P1 is thus raised to a level at least equal but typically greater than the external borehole pressure in the region of the seal 232. P1 is thus now greater than P2, creating a positive pressure differential across the seal 232. This opens the channels 282 of the valve 272 such that fluid is pumped into the chamber 238. As long as the pressure P1 of the supplied fluid is equal/greater than the external borehole pressure, the valve member 272 is maintained open, as shown in FIG. 11. The seal 232 can thus be fully inflated.

Figure 14:
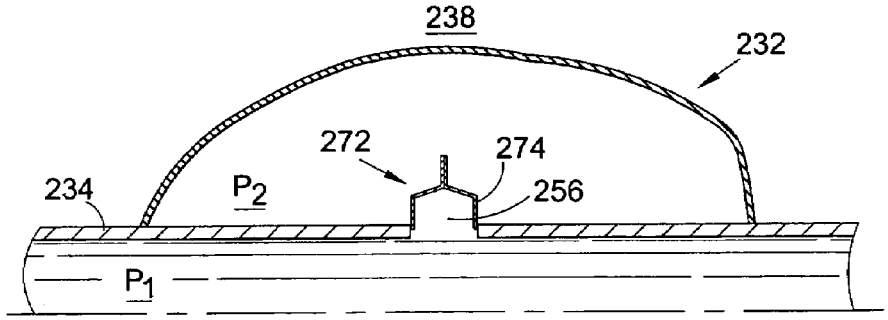
FIG. 14 is a view of the seal of FIG. 11 shown following inflation.

The applied fluid pressure is then reduced or supply of further fluid to the chamber 238 is prevented, such that the pressure P1 within the support tube 234 drops, and is now less than the pressure P2 of fluid within the chamber 238. This causes the channels 282 of the valve 272 to close, as shown in FIG. 14, preventing fluid escape from the chamber 238 and thus maintaining the seal tube inflated. It will be understood that there may be a small return flow of fluid from the chamber 238 at the initial stage when the pressure of the supplied fluid P1 drops down to below the pressure P2 of fluid in the chamber 238. However, when the channels 282 collapse, further fluid escape is prevented.

It will be understood that the features of the seal 232 may be provided in combination with the seal 32 of FIGS. 1 to 9. Thus in a further embodiment of the present invention, a seal may be provided based upon the structure of the seal 32, including appropriate apertures and plugs which are removable on expansion of a support tube of the seal, and further including collapsible valve members such as the valve members 272 of the seal 232. This may avoid the requirement to provide the screen 60 and filler material 64 of the seal 32, allowing inflation of the seal tube and maintained inflation of said tube by applied fluid pressure, as in the seal 232. It will also be understood that, whilst the pressure of fluid within the support tube 234 of the seal 232 may be controlled to ensure that the pressure P1 is maintained lower than the pressure P2 until inflation of the seal tube is desired (to prevent premature inflation), the incorporation of plugs into the seal 232 in this fashion may ensure that the seal tube cannot be inflated until the support tube 232 has been expanded, opening fluid communication with the chamber 238. In a further alternative embodiment, the seal 232 may be provided also including a screen and filler such as those described in relation to the seal 32 of FIGS. 1 to 9.

Figure 15:
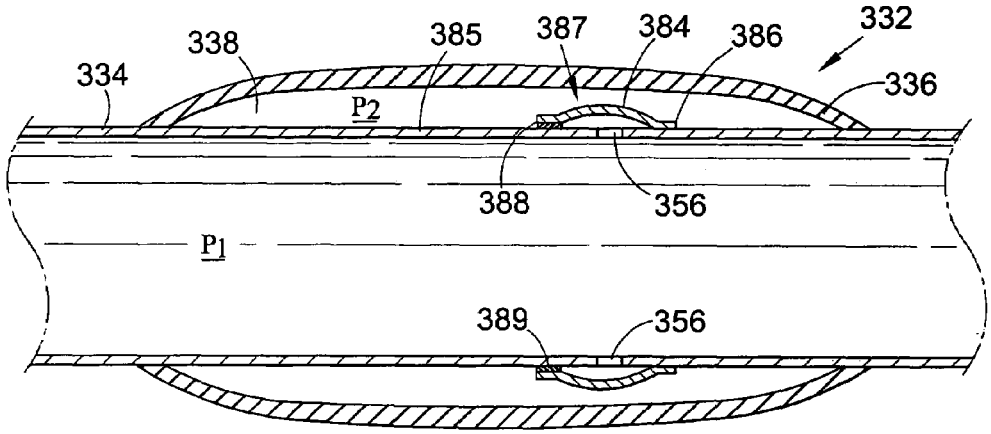
FIG. 15 is a schematic cross-sectional view of a seal, having an expandable downhole tubular including a flow port, in accordance with a further alternative embodiment of the present invention, shown following expansion of the tubular and prior to inflation of a seal element of the seal.

Turning now to FIG. 15, there is shown a schematic cross-sectional view of a seal, having an expandable downhole tubular with at least one flow port, in accordance with a further alternative embodiment of the present invention, the seal indicated generally by reference numeral 332. The seal 332 is similar to the seal 32 of FIGS. 1-9, and like components share the same reference numerals incremented by 300.

The seal 332 is shown in FIG. 15 following expansion of a support tube 334, and prior to inflation of a seal tube 336 of the seal. In place of the plugs and screen 60 employed in the seal 32, the seal 332 includes a sealing member 384. The sealing member 384 is annular and is coupled to an outer surface 385 of the support tube 334, and is movable between a closed position where fluid flow through apertures 356 is prevented, and an open position, shown in FIG. 16, where fluid flow through the apertures 356 is permitted.

In more detail, the sealing member 384 is of a material having a higher Young's modulus (elasticity) than the support tube 334; for example, the sealing member 384 may be of a Titanium alloy and the support tube 334 of a Steel. The sealing member 384 has an end 386 which is secured to the support tube outer surface, such as by welding, and a deformable portion 387. The deformable portion 388 defines a free end 388 which is fitted to the support tube 334 in an interference fit, with an optional seal (such as an elastomeric O-ring or seal sleeve) 389. The portion 387 is typically elastically deformable, and is movable between the closed and open positions in response to applied fluid pressure, as will be described below.

The sealing member 384 seals the apertures 356 both prior to expansion of the support tube 334, allowing the seal 332 to be run-in and located in the borehole 10. The support tube 334 is then expanded, in the same way as the seal 32 of FIGS. 1-9, which is illustrated in FIG. 15. The pressure P1 of fluid in the support tube 334 is then raised, exerting a fluid pressure force on the sealing member 384. The deformable portion 387 initially resists this applied fluid pressure force, maintaining the apertures 356 closed. When the pressure P1 is raised to a level above a determined operating pressure (which is equal/greater than the pressure P2 of fluid in the chamber 338, equivalent to external borehole pressure), the fluid pressure force on the sealing member 384 becomes sufficiently large as to elastically deform the portion 387 to the open position illustrated in FIG. 16. The apertures 356 are thus now opened, and fluid is supplied under pressure to the chamber 338 to inflate the seal tube 336, in the fashion described above.

When the fluid pressure P1 is reduced, a combination of a fluid pressure differential (P2 now being greater than P1) and elastic recovery of the sealing member portion 387 returns the sealing member 384 to the closed position of FIG. 15. This closes the apertures 356, preventing fluid escape from the chamber 338 and thus maintains the seal tube 336 inflated.

Figure 17:
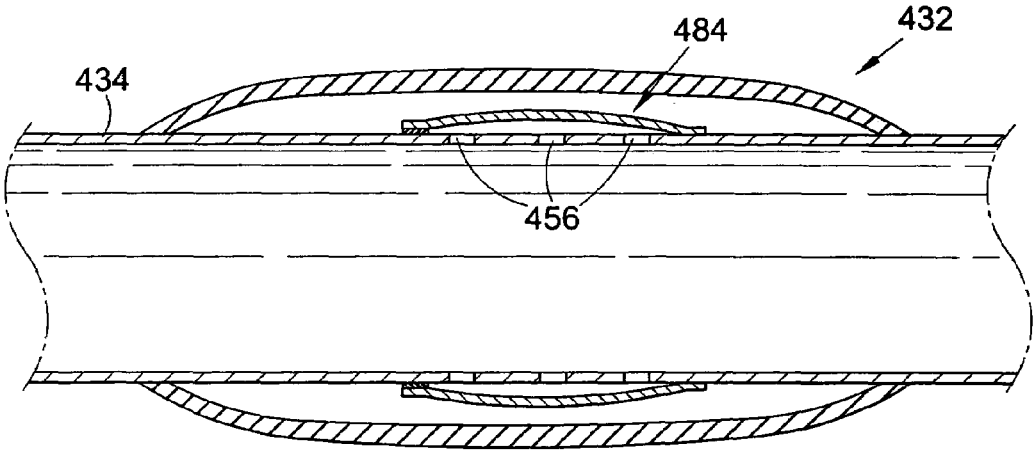
FIG. 17 is a schematic cross-sectional view of a seal, having an expandable downhole tubular including a flow port, in accordance with a still further alternative embodiment of the present invention, shown following expansion and prior to inflation of a seal element of the seal.

Turning now to FIG. 17, there is shown a schematic cross-sectional view of a seal, having an expandable downhole tubular with at least one flow port, in accordance with a still further alternative embodiment of the present invention, the seal indicated generally by reference numeral 432. The seal 432 is shown following expansion and inflation and with apertures 456 in a support tube 434 closed.

Figure 16:
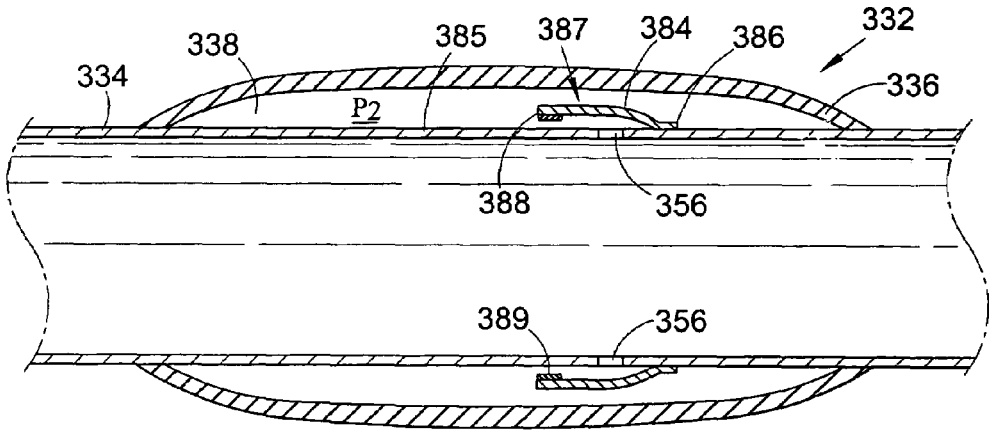
FIG. 16 is a view of the seal of FIG. 15 during inflation of the seal element.

The seal 432 is in fact much the same as the seal 332 of FIGS. 15 and 16, except it includes a sealing member 484 which extends along a greater length of the support tube 434, and serves for opening and closing a number of rows of longitudinally adjacent apertures 456.

In a variation on the seals 332 and 432, a sealing member may be coupled to an internal surface of the respective support tube. In this embodiment, the sealing member would typically be of a material having a Young's modulus less than that of the support tube, facilitating adequate operation of the sealing member post expansion, by ensuring the sealing member remains coupled to the support tube post expansion.

In a further variation, the sealing member of the seals 332, 432 may include a deformable portion, which, following expansion, is plastically deformable. In this way, the plastically deformable portion may be urged closed by a fluid pressure force acting on the sealing member due to a differential pressure between fluid at a higher pressure in the chamber compared to that inside the support tube, with no elastic recovery.

It will be understood that the features of the seals 332 or 432 may be provided in combination with any of the above-described features of the seals 32, 132 and/or 232.

Furthermore, the principles of sealing the respective expandable support tubes of the seals 332, 432 may be applied to any desired type of expandable downhole tubular, and are not limited to the tubulars of seals of the type described herein.

It will also be understood by those skilled in the art that the above described embodiments and concepts of the invention are by way of illustration only and are not intended to limit the scope of the invention. Accordingly, various modifications may be made to the foregoing within the spirit and scope of the present invention.

For example, the seal element may comprise a plastics or other suitable material.

The seal may comprise a plurality of separate chambers. Thus a selected one or more chamber of the seal may be inflated as desired.

The seal/seal assembly may also be used in a tubing lined borehole, for example, where a casing has deteriorated causing undesired fluid ingress. In these circumstances, the seal/assembly may be used as a Apatch@ to straddle the damaged tubing section, although there would be a resultant decrease in the tubing bore diameter.

The seal element may be urged radially by exerting an axial force on the seal element. For example, the chamber may be provided at one end of the seal element and, when inflated, the chamber may exert an axial force on the seal element, to squeeze the seal element and urge it radially outwardly. Thus, the chamber may be defined between an upper or lower end of the seal element and the support tube. Alternatively, there may be one such chamber at each end of the seal element. The seal element may be of any suitable swelling (for example, in water or hydrocarbons such as oils) or non-swelling material capable of acting as a seal.

When the seal is expanded, the seal element may be brought into contact with the borehole wall providing an initial seal which is enhanced when the seal element is inflated. This depends on a number of factors including relative dimensions of the seal/borehole and the nature of the drilled borehole.

When the seal is expanded, the seal element may be brought into contact with the borehole wall providing an initial seal which is enhanced when the seal element is inflated. This depends on a number of factors including relative dimensions of the seal/borehole and the nature of the drilled borehole.

The seal assembly may be expanded in either a bottom-up or top-down expansion procedure appropriate to the peculiarities of the well in which the seal assembly is to be located. For example, a top-down expansion procedure is suitable where large forces (imposed by heavy drill collars in the tool string) can be applied to an expansion tool. This may not be possible where the well is deviated and/or where a workover rig is used for deploying the tool; in these cases, a bottom-up expansion procedure may be more suitable.

The apertures in the support tube may be of any suitable shape in addition to circular. For example, part of the support tube may be slotted or otherwise perforated and on expansion may form diamond or other shaped openings. The plugs may be fitted into the apertures in a friction fit, or a snap fit, for example, the plugs may carry a snap ring for engaging a groove in a wall of the apertures, or vice versa. Thus, on expansion of the support tube whereby the apertures are deformed, the plugs may disengage and fall out of the apertures. The plugs may also or alternatively be of a material which is crushed or pulverised on expansion of the support tube by the expansion tool, to open the apertures. The plugs may thus be of a ceramic or like material.

The inflatable seal elements may be inflatable in any suitable fashion, for example, using a supplied gas or other fluid, or by generation of a gas downhole, for example by reaction of a suitable material in the seal with a suitable reactant fluid.

The invention claimed is:

1. A sealing apparatus for use in a wellbore, comprising:

an expandable tubular support member having a flow port; and an inflatable seal element mounted externally of the expandable tubular support member for inflation radially outwardly into sealing engagement with at least a portion of the wellbore, wherein the flow port provides a flow path between an interior of the support member and a chamber defined by the seal element, wherein the chamber is adapted for inflation to urge the seal element radially outwardly and is adapted to be initially isolated from annulus pressure and fluid in the wellbore.

2. The sealing apparatus of claim 1, wherein the portion of the wellbore is lined with a tubular.

3. The sealing apparatus of claim 1, wherein the chamber is annular and at least partially defined by the seal element and the support member.

4. The sealing apparatus of claim 1, further comprising a filler material adapted for maintaining the seal element in sealing engagement with the wellbore.

5. The sealing apparatus of claim 4, wherein the filler material is adapted to react with a reactant to solidify and maintain the chamber in an inflated condition.

6. The sealing apparatus of claim 4, wherein the filler material comprises a granular solid material.

7. The sealing apparatus of claim 1, the chamber containing a filler material adapted for maintaining the seal element under pressure in sealing engagement with the wellbore.

8. The sealing apparatus of claim 1, wherein the seal element is adapted to be inflated by applied fluid pressure.

9. The sealing apparatus of claim 8, comprising a reactant fluid for reacting with a filler material in the seal element to form a single, solid member for maintaining the seal element inflated.

10. The sealing apparatus of claim 1, wherein the inflated seal element circumferentially contacts the wellbore.

11. A sealing apparatus, the sealing apparatus comprising:

an expandable tubular support member having a flow port;

an inflatable seal element mounted externally of the expandable tubular support member for inflation radially outwardly into sealing engagement with at least a portion of the wellbore, wherein the flow port provides a flow path between an interior of the support member and a chamber defined by the seal element; and a sealing member coupled to the expandable tubular, the sealing member including a deformable portion movable between a closed position preventing fluid flow through the flow port and an open position permitting fluid flow through the flow port.

12. A sealing apparatus as claimed in claim 11, wherein the sealing member is adapted to be expanded on expansion of the expandable tubular.

13. A sealing apparatus as claimed in claim 11, wherein the deformable portion is normally urged towards the closed position.

14. A sealing apparatus as claimed in claim 11, wherein the deformable portion is plastically deformable.

15. A sealing apparatus as claimed in claim 11, wherein the deformable portion is movable between the closed and open positions in response to an applied fluid pressure force.

16. A sealing apparatus as claimed in claim 15, wherein the deformable portion is adapted to move to the open position in response to an applied fluid pressure force of a determined magnitude.

17. A sealing apparatus as claimed in claim 11, wherein the sealing member is mounted externally of the expandable tubular.

18. A sealing apparatus as claimed in claim 17, wherein the sealing member is secured to an outer surface of the tubular.

19. A sealing apparatus as claimed in claim 11, wherein the sealing member is of a material having a lower Young's modulus than the expandable tubular.

20. A sealing apparatus as claimed in claim 11, wherein the sealing member is annular and has an end adapted to be secured to the expandable tubular.

21. A sealing apparatus as claimed in claim 20, wherein the other end of the sealing member engages the expandable tubular in an interference fit.

22. A sealing apparatus as claimed in claim 11, wherein the sealing member is adapted for sealing a plurality of flow ports spaced around a circumference of the expandable tubular.

23. A sealing apparatus as claimed in claim 11, wherein the sealing member is adapted for sealing a plurality of flow ports spaced along a length of the expandable tubular.

24. A sealing apparatus as claimed in claim 23, wherein the sealing member is a sleeve.

25. A method of sealing a portion of a wellbore, comprising:

providing one or more expandable seals, the one or more expandable seals having:

a tubular support member; and a seal element mounted on the tubular support member;

locating the one or more expandable seals in the wellbore;

expanding the tubular support member; and inflating the seal element radially outwardly into sealing engagement with the wellbore, wherein the seal element is inflated by supplying a fluid under pressure to the seal element and the fluid is pressurized above a pore pressure of a rock formation in the region of the wellbore adjacent the seal.

26. The method of claim 25, wherein the support member is mechanically expanded.

27. The method of claim 26, wherein the seal element is expanded when the support member is expanded.

28. The method of claim 25, further comprising maintaining the seal element in sealing engagement with the wellbore.

29. The method of claim 25, wherein the fluid is supplied to a chamber between the support member and the seal element.

30. The method of claim 25, wherein the fluid reacts with a filler material in the seal to form a viscous mass for maintaining the seal element inflated and under pressure.

31. The method of claim 25, further comprising enlarging the wellbore before locating the one or more expandable seals.

32. The method of claim 25, wherein the one or more expandable seals comprise a first expandable seal coupled to a second expandable seal.

33. The method of claim 32, wherein the first and second expandable seals are coupled to an expandable tubular.

34. The method of claim 33, further comprising expanding the expandable tubular.

35. A method of sealing a portion of a wellbore, comprising:

providing one or more expandable seals, the one or more expandable seals having:

a tubular support member; and a seal element mounted on the tubular support member;

locating the one or more expandable seals in the wellbore;

expanding the tubular support member;

inflating the seal element radially outwardly into sealing engagement with the wellbore; and providing an expandable sandscreen around the seal and expanding the sandscreen by inflating the seal element of the seal.

36. A method for isolating a wellbore, comprising:

running a sealing apparatus into the wellbore, the sealing apparatus having:

a tubular;

a sealing element disposed around the tubular;

an annular area defined between the tubular and the sealing element; and a fluid retaining material disposed in the annular area, wherein the material is a swelling elastomer;

supplying a fluid into the annular area;

increasing the volume of the annular area; and reacting the fluid retaining material with the fluid, thereby maintaining at least a portion of the increased volume.

37. The method of claim 36, wherein increasing the volume comprises inflating the sealing element.

38. The method of claim 36, wherein the fluid retaining material increases in size after reacting with the fluid.

39. The method of claim 36, wherein reacting the fluid retaining material with the fluid forms a viscous mixture.

40. The method of claim 36, further comprising expanding the tubular.

41. A method for isolating a wellbore, comprising:

running a packer into the wellbore, the packer having a sealing element and a filler material, wherein the filler material is disposed in the packer prior to the running;

introducing a fluid into the packer after running the packer into the wellbore, the fluid for inflating the sealing element into contact with the wellbore; and reacting the filler material with the fluid in the packer, thereby maintaining the sealing element in an inflated state.

42. The method of claim 41, further comprising supplying fluid to the packer to inflate the sealing element.

43. The method of claim 41, wherein the filler material swells upon contact with the fluid.

44. The method of claim 41, wherein the sealing element maintains a sealing contact with the wellbore after inflation.

45. The method of claim 41, wherein reacting the filler material with the fluid forms a viscous mixture.

46. The method of claim 45, wherein the mixture solidifies over time.

47. A sealing apparatus, comprising:

a tubular;

a sealing element disposed around the tubular;

an annular area defined between the tubular and the sealing element;

a material disposed in the annular area, the material adapted to retain at least a portion of a fluid supplied to the annular area, wherein the fluid comprises water.

48. The sealing apparatus of claim 47, wherein the material increases in size upon contact with the fluid.

49. The sealing apparatus of claim 47, wherein the sealing element is expandable by the fluid.

50. The sealing apparatus of claim 47, wherein the material and the retained fluid maintains the sealing element in an expanded state.

51. The sealing apparatus of claim 47, wherein the material is selected from the group consisting of a polymer, swelling elastomer, bentonite, clay, and combinations thereof.

52. The sealing apparatus of claim 47, wherein the tubular comprises an expandable tubular.

53. The sealing apparatus of claim 52, wherein expansion of the expandable tubular also expands the sealing element.

54. The sealing apparatus of claim 47, wherein the fluid reacts with the filler material to form a viscous mass, for maintaining the seal element inflated.

55. The sealing apparatus of claim 47, further comprising a sealing member for controlling application of fluid pressure to the seal element and for maintaining inflation of the seal element.

56. The sealing apparatus of claim 55, wherein the sealing member comprises a generally tubular valve member adapted to open when fluid pressure within the valve member is at least equal to the pressure of fluid outside the valve member and adapted to close when fluid pressure within the valve member is less than that outside the valve member.

57. The sealing apparatus of claim 56, wherein the tubular valve member is collapsible to close the valve.

58. The sealing apparatus of claim 47, further comprising a sealing member coupled to the tubular, the sealing member having a deformable portion movable between a closed position and an open position for controlling application of fluid pressure to the seal element.

59. The sealing apparatus of claim 58, wherein the sealing member is expandable together with the tubular.

60. The sealing apparatus of claim 58, wherein the sealing member is movable between the closed and open positions in response to an applied fluid pressure force.

61. The sealing apparatus of claim 58, wherein the sealing member is mounted externally of the tubular and is of a material having a Young's modulus greater than that of the tubular.

62. The sealing apparatus of claim 47, wherein the seal element is elastically deformable.

63. The sealing apparatus of claim 47, wherein the seal element comprises an elastomeric material.

64. The sealing apparatus of claim 47, wherein the tubular includes at least one aperture for fluid communication between the seal element and the interior of the tubular.

65. The sealing apparatus of claim 64, wherein the support member includes a plug for closing the at least one aperture to initially prevent fluid communication between the seal element and the interior of the tubular.

66. The sealing apparatus of claim 65, wherein the at least one aperture is openable by deformation of the plug.

67. The sealing apparatus of claim 66, wherein the plug is adapted to be crushed to open the at least one aperture.

68. The sealing apparatus of claim 65, wherein the plug includes a hollow portion and an end cap for closing flow through the hollow portion, and wherein the end cap is removable to allow fluid communication through the hollow portion.

69. The sealing apparatus of claim 65, wherein the plug is removable to allow fluid communication.

70. The sealing apparatus of claim 69, wherein the plug is releasably engageable in the at least one aperture and is adapted to disengage the at least one aperture to allow fluid communication on expansion of the tubular.

71. The sealing apparatus of claim 64, further comprising a sealing member for controlling application of fluid pressure through the at least one aperture to the seal element and for maintaining inflation of the seal element.

72. The sealing apparatus of claim 64, further comprising a sealing member for controlling application of fluid pressure to the seal element and for maintaining inflation of the seal element, the sealing member adapted to seal a plurality of apertures.

73. The sealing apparatus of claim 64, wherein the tubular is at least partially perforated.

74. The sealing apparatus of claim 47, comprising an expandable sandscreen located around the seal, the sandscreen adapted to be expanded by inflation of the inflatable seal element of the seal.

75. The sealing apparatus of claim 47, further comprising a screen member provided between the seal element and the tubular.

76. The sealing apparatus of claim 75, wherein a pore size of the screen member is smaller than the average size of the filler material.

77. The sealing apparatus of claim 47, further comprising at least one reinforcing member for reinforcing the seal element to support the seal element during expansion.

78. The sealing apparatus of claim 77, wherein the sealing apparatus includes a reinforcing member at each end of the seal element to contain inflation of the seal element.

79. The sealing apparatus of claim 77, wherein the reinforcing member is integral with the seal element or separate from the seal element.

* * * * *